US007354251B2

(12) United States Patent
Cho et al.

(10) Patent No.: US 7,354,251 B2
(45) **Date of Patent: *Apr. 8, 2008**

(54) VARIABLE CAPACITY ROTARY COMPRESSOR

(75) Inventors: Sung Hae Cho, Suwon (KR); Seung Kap Lee, Suwon (KR); Chun Mo Sung, Hwasung (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 764 days.

This patent is subject to a terminal disclaimer.

(21) Appl. No.: 10/843,335

(22) Filed: May 12, 2004

(65) Prior Publication Data

US 2005/0063849 A1 Mar. 24, 2005

(30) Foreign Application Priority Data

Sep. 19, 2003 (KR) ..... 10-2003-0065123

(51) Int. Cl.
*F04B 1/06* (2006.01)

(52) U.S. Cl. ..... 417/221

(58) Field of Classification Search ..... 417/221, 417/216, 218, 223, 326, 242, 287, 440, 441; 418/29, 60

See application file for complete search history.

(56) References Cited

U.S. PATENT DOCUMENTS

| | | | | |
|---|---|---|---|---|
| 6,796,773 | B1 * | 9/2004 | Choi et al. | 417/221 |
| 7,153,109 | B2 * | 12/2006 | Cho et al. | 418/29 |
| 7,223,081 | B2 * | 5/2007 | Lee et al. | 417/221 |
| 7,226,275 | B2 * | 6/2007 | Lee et al. | 417/221 |
| 2005/0112010 | A1 * | 5/2005 | Cho et al. | 418/11 |

FOREIGN PATENT DOCUMENTS

JP 2001-280253 10/2001

* cited by examiner

*Primary Examiner*—Michael Koczo, Jr.
(74) *Attorney, Agent, or Firm*—Staas & Halsey LLP

(57) ABSTRACT

A variable capacity rotary compressor including a hermetic casing in which a housing having first and second compression chambers is installed. A compressing unit is placed in the first and second compression chambers, and is operated to execute a compression operation in either the first or second compression chamber according to a rotating direction of a rotating shaft which drives the compressing unit. The variable capacity rotary compressor also includes a first path, a second path, and a pressure control unit. The first path connects an outlet side of the rotary compressor to an inlet of the first compression chamber. The second path connects the outlet side of the rotary compressor to an inlet of the second compression chamber. The pressure controller functions to open either the first or second path, so that a pressure of the outlet side of the rotary compressor acts on the inlet of the first or second compression chamber where the idle operation is executed.

24 Claims, 9 Drawing Sheets

VARIABLE CAPACITY ROTARY COMPRESSOR

CROSS-REFERENCE TO RELATED APPLICATIONS

This application claims the benefit of Korean Patent Application No. 2003-65123, filed Sep. 19, 2003 in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor which has a pressure controller to allow an internal pressure of a compression chamber where an idle operation is executed, to be equal to an internal pressure of a hermetic casing.

2. Description of the Related Art

Recently, a variable capacity compressor has been increasingly used in a variety of refrigeration systems, such as air conditioners or refrigerators, so as to vary a cooling capacity as desired, thus accomplishing an optimum cooling operation and a saving of energy.

An earlier patent disclosure dealing with a variable capacity compressor is found in U.S. Pat. No. 4,397,618. According to the patent, a rotary compressor is designed to vary a compression capacity thereof by holding or releasing a vane. The rotary compressor includes a casing in which a cylindrical compression chamber is provided. A rolling piston is installed in the compression chamber of the casing to be eccentrically rotated. Further, a vane, designated as a "slide" in U.S. Pat. No. 4,397,618, is installed in the casing, and reciprocates in a radial direction while being in contact with an outer surface of the rolling piston. A vane holding unit, which includes a ratchet bolt, an armature, and a solenoid, is provided at a side of the vane to hold or release the vane, thus varying the compression capacity of the rotary compressor. That is, the vane is held or released in response to a reciprocating movement of the ratchet bolt controlled by the solenoid, thus varying the compression capacity of the rotary compressor.

However, the conventional variable capacity rotary compressor has a problem in that it is designed such that the compression operation thereof is controlled by holding or releasing the vane for a predetermined period of time, so it is difficult to precisely vary the compression capacity to obtain a desired exhaust pressure.

Further, the conventional variable capacity rotary compressor has another problem in that the ratchet bolt holding the vane is designed to enter a side of the vane and be locked to a locking hole formed at the vane, so it is not easy to hold the vane which reciprocates at a high speed when the compressor is operated, thus having poor reliability.

SUMMARY OF THE INVENTION

Accordingly, it is an aspect of the present invention to provide a variable capacity rotary compressor, which is designed to precisely vary a compression capacity to obtain a desired exhaust pressure, and to easily control an operation of varying the compression capacity.

It is another aspect of the present invention to provide a variable capacity rotary compressor which has a pressure controller to allow an internal pressure of a compression chamber where an idle operation is executed, to be equal to an internal pressure of a hermetic casing, which is a pressure of an outlet side of the rotary compressor, thus preventing a vane from pressing an outer surface of a roller and preventing oil from flowing into the compression chamber, therefore minimizing a rotating resistance.

Further aspect of the invention provides a rotary compressor in which a vane to rotate while pressing an outer surface of a roller which executes an idle rotation does not cause oil to flow into a compression chamber where the idle operation is executed. This results in preventing an increase in a rotating resistance.

Additional aspects and/or advantages of the invention will be set forth in part in the description which follows and, in part, will be obvious from the description, or may be learned by practice of the invention.

The above and/or other aspects are achieved by a variable capacity rotary compressor, including a hermetic casing, a housing, a compressing unit, first and second paths, and a pressure control unit. The housing is installed in the hermetic casing to define therein first and second compression chambers having different capacities. The compressing unit is placed in the first and second compression chambers, and is operated to execute a compression operation in either the first or second compression chamber according to a rotating direction of a rotating shaft which drives the compressing unit. The first path connects an outlet side of the rotary compressor to an inlet of the first compression chamber. The second path connects the outlet side of the rotary compressor to an inlet of the second compression chamber. The pressure controller opens either the first or second path, so that a pressure of the outlet side of the rotary compressor acts on the inlet of the first or second compression chamber where an idle operation is executed.

The pressure controller may include a connection pipe, first and second pressure control pipes, and a pressure control valve. An inlet of the connection pipe may communicate with an interior of the hermetic casing. The first pressure control pipe may branch from the connection pipe, with an outlet of the first pressure control pipe communicating with the inlet of the first compression chamber, so that the first pressure control pipe defines the first path. The second pressure control pipe may branch from the connection pipe, with an outlet of the second pressure control pipe communicating with the inlet of the second compression chamber, so that the second pressure control pipe defines the second path. The pressure control valve may be provided at a branching point of the first and second pressure control pipes, and be operated by a pressure difference between the first and second pressure control pipes to open either the first or second path.

The pressure control valve may include a valve body and a valve member. The valve body may have an inlet and first and second outlets. The inlet may be provided at a central portion of the valve body to be connected to an outlet of the connection pipe. The first outlet may be provided at a first side of the valve body to be connected to an inlet of the first pressure control pipe. The second outlet may be provided at a second side of the valve body opposite to the first outlet to be connected to an inlet of the second pressure control pipe. The valve member may be provided in the valve body to reciprocate and to open either the first or second path.

The pressure control valve may further include a restoring elastic member provided at each of opposite sides of the valve member to allow the valve member to be returned to a center of the valve body when the rotary compressor is stopped.

The above and/or other aspects are achieved by a variable capacity rotary compressor, including a hermetic casing, a housing, a compressing unit, a path controller, first and second paths, and a pressure controller. The housing is installed in the hermetic casing to define therein first and second compression chambers having different capacities. The compressing unit is placed in the first and second compression chambers, and is operated to execute a compression operation in either the first or second compression chamber according to a rotating direction of a rotating shaft which drives the compressing unit. The path controller functions to control a refrigerant suction path so that a refrigerant is fed to an inlet of either the first or second compression chamber where the compression operation is executed. The first path connects an outlet side of the rotary compressor to a first outlet of the path controller so that the outlet side of the rotary compressor communicates with the first outlet of the path controller. The second path connects the outlet side of the rotary compressor to a second outlet of the path controller so that the outlet side of the rotary compressor communicates with the second outlet of the path controller. The pressure controller functions to open either the first or second path, so that a pressure of the outlet side of the rotary compressor acts on the inlet of either the first or second compression chamber where an idle operation is executed.

The path controller may include a hollow body, a valve seat, and first and second valves. The hollow body may have an inlet and first and second outlets. The inlet may be provided at a central portion of the hollow body, and be coupled to a refrigerant inlet pipe. The first and second outlets may be respectively provided on the hollow body at opposite sides of the inlet of the hollow body to be coupled to the inlet ports of the first and second compression chambers. The valve seat may be provided in the hollow body to allow an interior of the valve seat to communicate with the inlet of the hollow body and allow both ends of the vale seat to communicate with the first and second outlets of the hollow body, respectively. The first and second valves may be respectively provided at each of both ends of the valve seat, and axially reciprocate in the hollow body to open either of the both ends of the valve seat. The first and second valves may be coupled to each other by a connecting member.

The pressure controller may include a connection pipe, first and second pressure control pipes, and a pressure control valve. An inlet of the connection pipe may communicate with an outlet side of the rotary compressor. The first and second pressure control pipes may branch from the connection pipe, with outlets of the first and second pressure control pipes respectively communicating with opposite sides of the hollow body of the path controller, thus defining the first and second paths, respectively. The pressure control valve may be provided at a branching point of the first and second pressure control pipes, and be operated by a pressure difference between the first and second pressure control pipes to open either the first or second path.

Each of the first and second valves may include a thin valve plate able to come into contact with the valve seat, and a support member to support the valve plate in the hollow body.

A plurality of holes may be provided on the support member.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
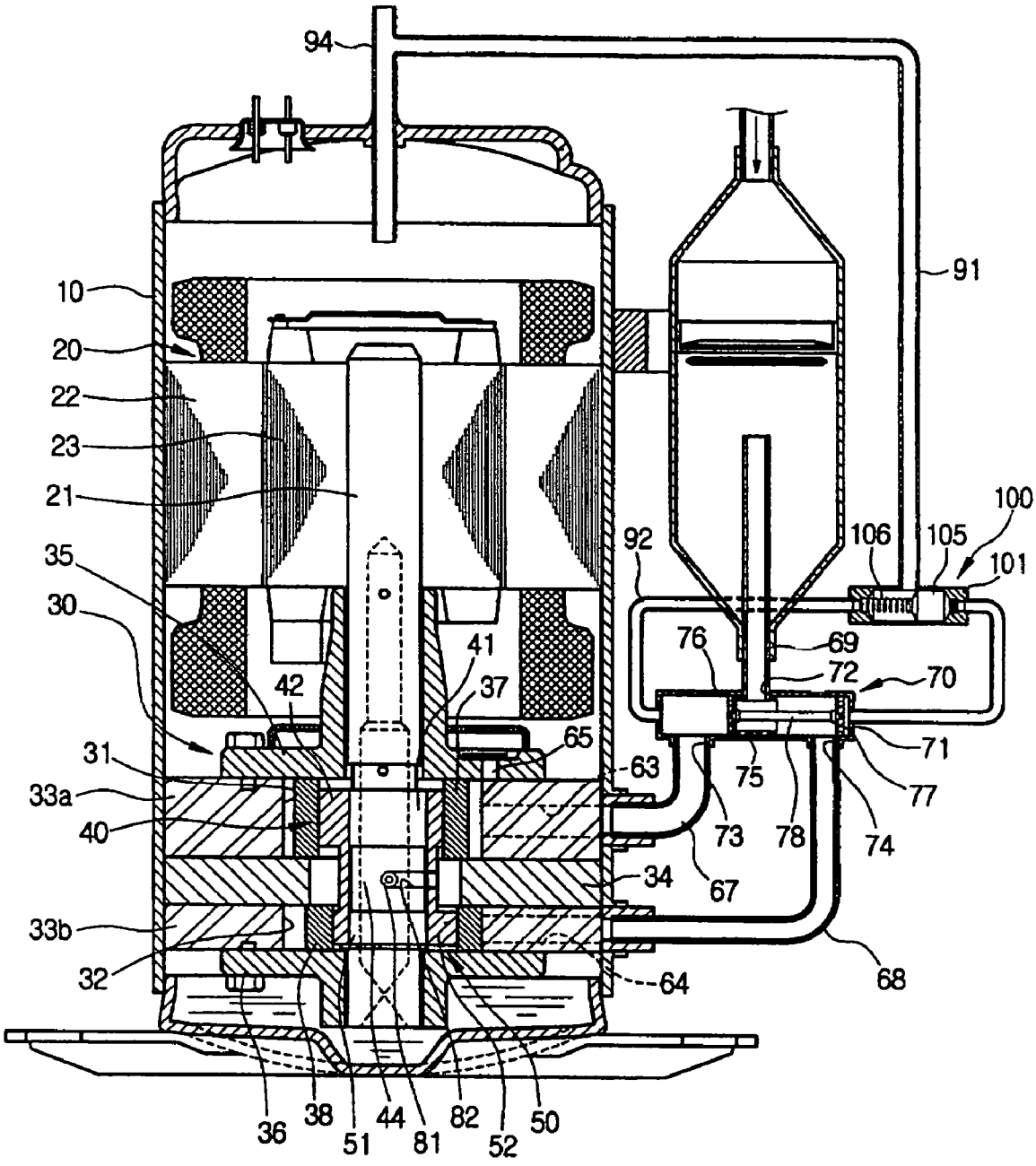
FIG. 1 is a sectional view of a variable capacity rotary compressor, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Reference will now be made in detail to the present embodiment of the present invention, examples of which are illustrated in the accompanying drawings, wherein like reference numerals refer to like elements throughout. The embodiment is described below in order to explain the present invention by referring to the figures.

As shown in FIG. 1, a variable capacity rotary compressor according to the present invention includes a hermetic casing 10, with a driver 20 and a compressing unit 30 being installed in the hermetic casing 10. The driver 20 is installed on an upper portion of the hermetic casing 10 to generate a rotating force. The compressing unit 30 is installed on a lower portion of the hermetic casing 10 to be connected to the driver 20 through a rotating shaft 21. The driver 20 includes a cylindrical stator 22 and a rotor 23. The stator 22 is mounted to an inner surface of the casing 10. The rotor 23 is rotatably and concentrically set in the stator 22, and is mounted to the rotating shaft 21. The driver 20 rotates the rotating shaft 21 in opposite directions.

The compressing unit 30 includes a housing. Cylindrical first and second compression chambers 31 and 32, having different capacities, are provided on upper and lower portions of the housing, respectively. The housing has a first housing part 33*a* to define the first compression chamber 31 therein, and a second housing part 33*b* to define the second compression chamber 32 therein. The housing also has upper and lower flanges 35 and 36 to rotatably support the rotating shaft 21. The upper flange 35 is mounted to an upper surface of the first housing part 33*a* to close an upper portion of the first compression chamber 31, and the lower flange 36 is mounted to a lower surface of the second housing part 33*b* to close a lower portion of the second compression chamber 32. A partition 34 is interposed between the first and second housing parts 33*a* and 33*b* so that the first and second compression chambers 31 and 32 are partitioned from each other.

As shown in FIGS. 1 to 4, the rotating shaft 21, installed in the first and second compression chambers 31 and 32, is provided with first and second eccentric units 40 and 50 which are arranged on upper and lower portions of the rotating shaft 21, respectively. First and second rollers 37 and 38 are rotatably fitted over the first and second eccentric units 40 and 50, respectively. A first vane 61 is installed between an inlet 63 and an outlet 65 of the first compression chamber 31, and reciprocates in a radial direction while contacting an outer surface of the first roller 37 to execute a compression operation in the first compression chamber 31. Further, a second vane 62 is installed between an inlet 64 and an outlet 66 of the second compression chamber 32, and reciprocates in the radial direction while being in contact with an outer surface of the second roller 38 to execute a compression operation in the second compression chamber 32. The first and second vanes 61 and 62 are biased by first and second vane springs 61*a* and 62*a*, respectively. Further, the inlet and outlet 63 and 65 of the first compression chamber 31 are arranged on opposite sides of the first vane 61. Similarly, the inlet and outlet 64 and 66 of the second compression chamber 32 are arranged on opposite sides of the second vane 62. Although not shown in the drawings in detail, the outlet ports 65 and 66 communicate with an interior of the hermetic casing 10 via a path defined in the housing.

Figure 2:
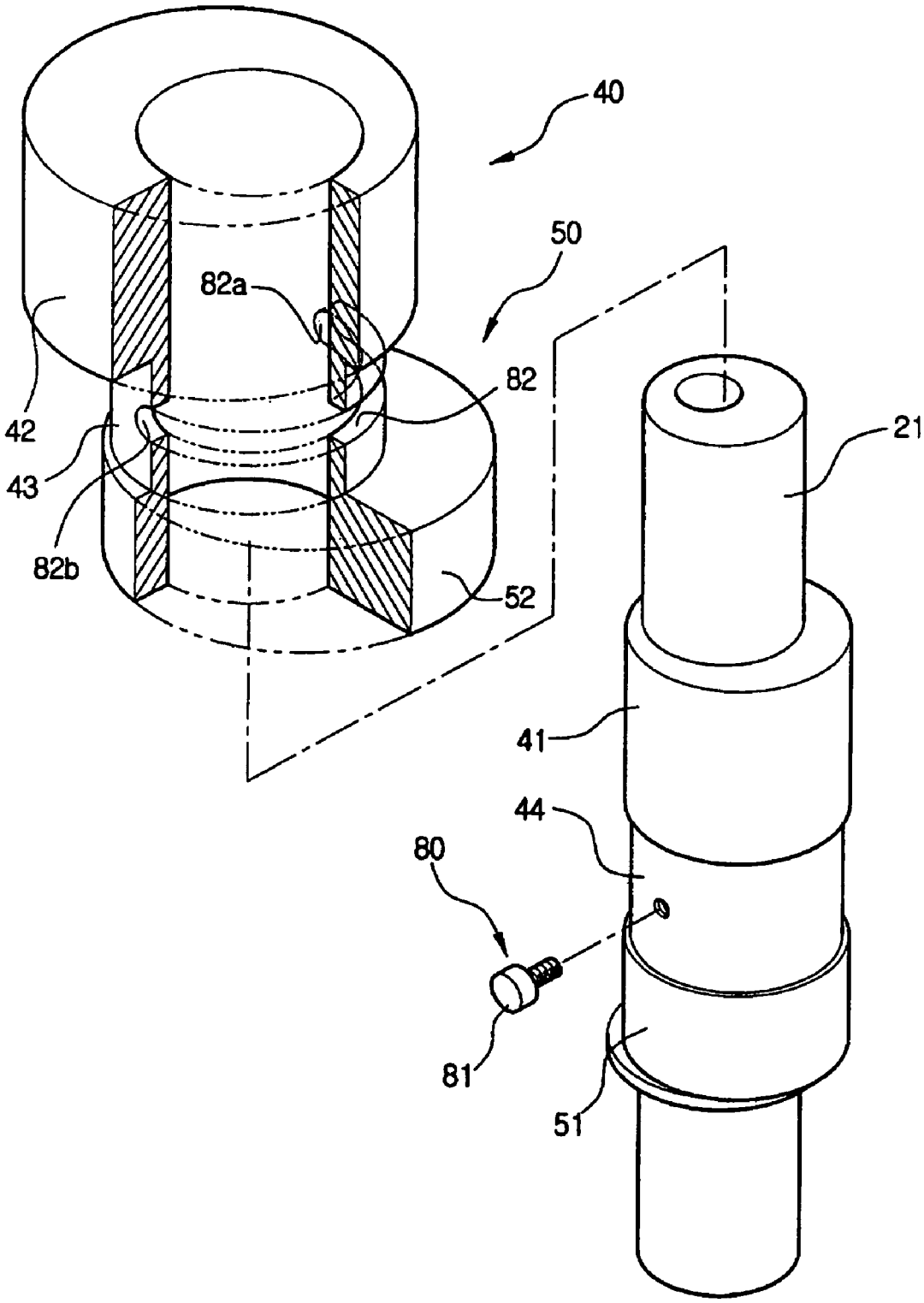
FIG. 2 is a perspective view of eccentric units included in the variable capacity rotary compressor of FIG. 1.

The first and second eccentric units 40 and 50 include first and second eccentric cams 41 and 51, respectively. The first and second eccentric cams 41 and 51 are provided on an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As shown in FIG. 2, the first and second eccentric bushes 42 and 52 are integrally connected to each other by a cylindrical connector 43, and are eccentric from the rotating shaft 21 in opposite directions. Further, the first and second rollers 37 and 38 are rotatably fitted over the first and second eccentric bushes 42 and 52, respectively.

Figure 3:
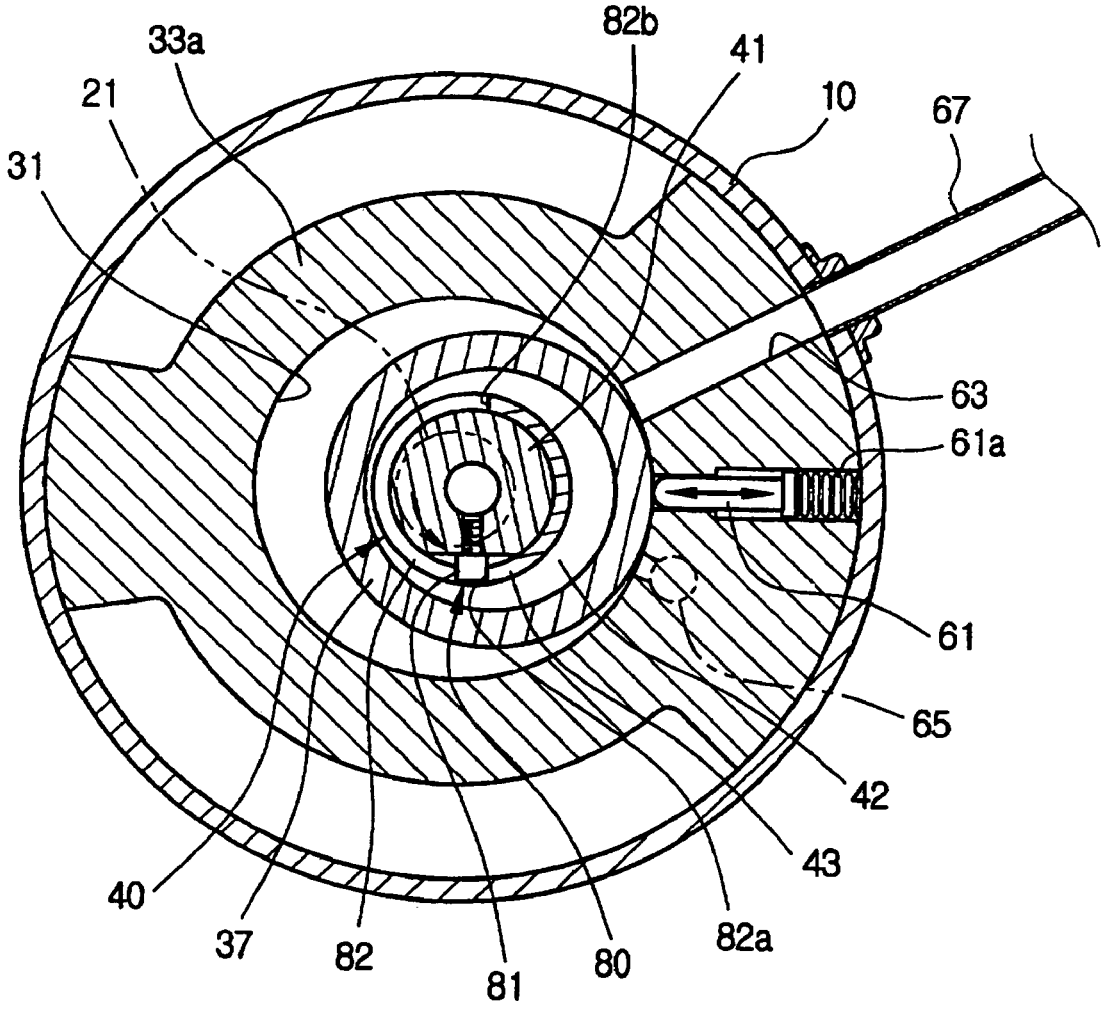
FIG. 3 is a sectional view to show a compression operation of a first compression chamber, when a rotating shaft of the variable capacity rotary compressor of FIG. 1 is rotated in a first direction.

As shown in FIGS. 2 and 3, an eccentric part 44 is provided on the outer surface of the rotating shaft 21 between the first and second eccentric cams 41 and 51 to be eccentric from the rotating shaft 21 in the same direction as the first and second eccentric cams 41 and 51. A locking unit 80 is mounted to the eccentric part 44. In this case, the locking unit 80 functions to make one of the first and second eccentric bushes 42 and 52 be eccentric from the rotating shaft 21 while releasing a remaining one of the first and second eccentric bushes 42 and 52 from eccentricity from the rotating shaft 21, according to a rotating direction of the rotating shaft 21. The locking unit 80 includes a locking pin 81 and a locking slot 82. The locking pin 81 is mounted to a surface of the eccentric part 44 in a screw-type fastening method to be projected from the surface of the eccentric part 44. The locking slot 82 is formed around a part of the connector 43 which connects the first and second eccentric bushes 42 and 52 to each other. The locking pin 81 engages with the locking slot 82 to make one of the first and second eccentric bushes 42 and 52 be eccentric from the rotating shaft 21 while a remaining one of the first and second eccentric bushes 42 and 52 is released from the eccentricity from the rotating shaft 21, according to the rotating direction of the rotating shaft 21.

When the rotating shaft 21 is rotated while the locking pin 81, which is mounted to the eccentric part 44 of the rotating shaft 21, engages with the locking slot 82 of the connector 43. The locking pin 81 is rotated within the locking slot 82 to be locked by either of first and second locking parts 82*a* and 82*b* which are formed at opposite ends of the locking slot 82 to cause the first and second eccentric bushes 42 and 52 to rotate along with the rotating shaft 21. Further, when the locking pin 81 is locked by either of the first and second locking parts 82*a* and 82*b* of the locking slot 82, one of the first and second eccentric bushes 42 and 52 is eccentric from the rotating shaft 21 and a remaining one of the first and second eccentric bushes 42 and 52 is released from the eccentricity from the rotating shaft 21 to execute the compression operation in one of the first and second compression chambers 31 and 32 and executing an idle operation in the other compression chamber. On the other hand, when the rotating direction of the rotating shaft 21 is changed, the first and second eccentric bushes 42 and 52 are arranged oppositely to the above-mentioned state.

As shown in FIG. 1, the variable capacity rotary compressor according to the present invention also includes a path controller 70. The path controller 70 controls a refrigerant suction path so that a refrigerant fed from a refrigerant inlet pipe 69 is delivered into either the inlet 63 of the first compression chamber 31 or the inlet 64 of the second compression chamber 32. Therefore, the refrigerant is delivered into the inlet of the compression chamber where the compression operation is executed.

Figure 7:
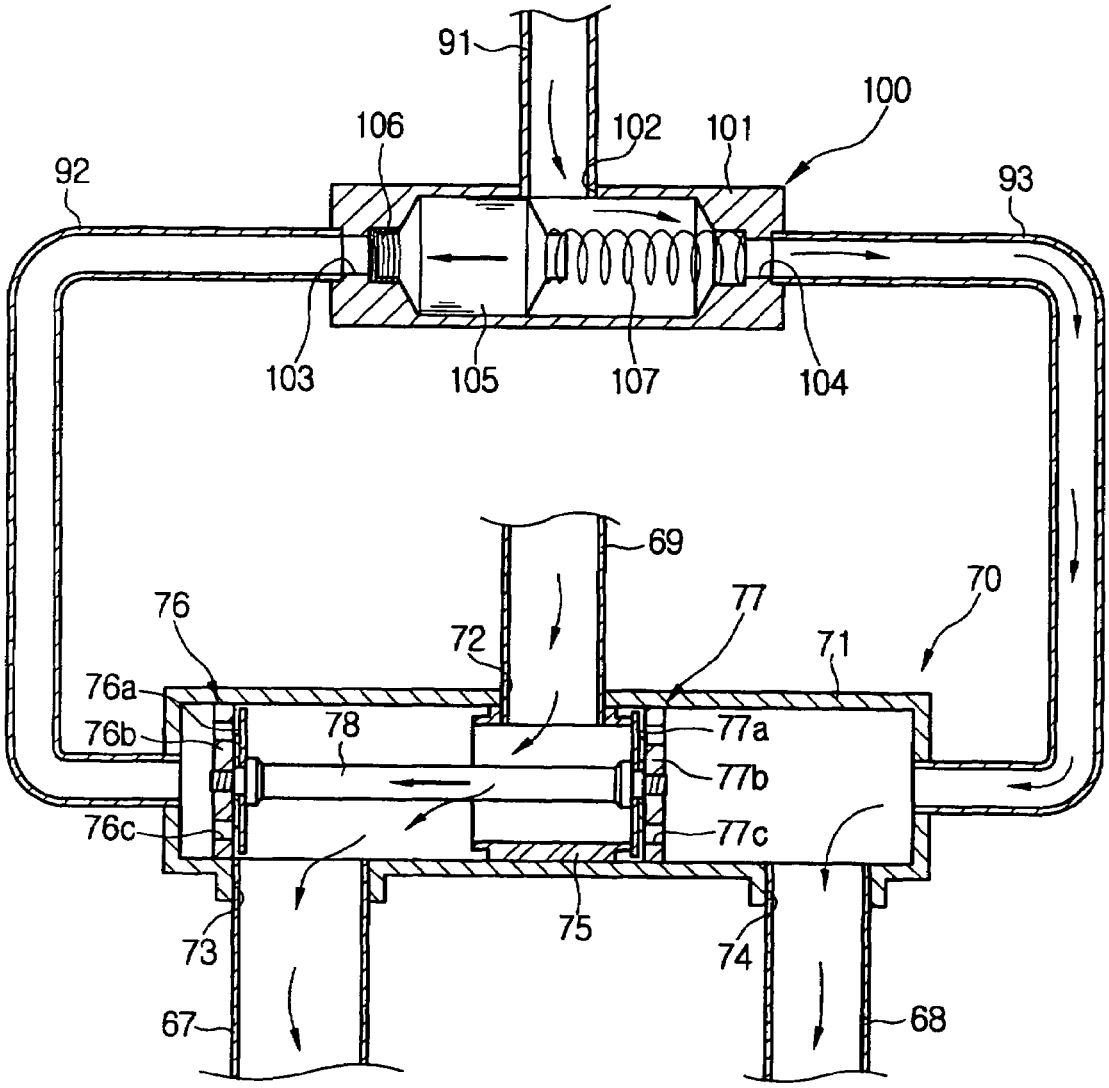
FIG. 7 is a sectional view to show a path controller and a pressure controller included in the variable capacity rotary compressor of FIG. 1, when the compression operation is executed in the first compression chamber.
Figure 8:
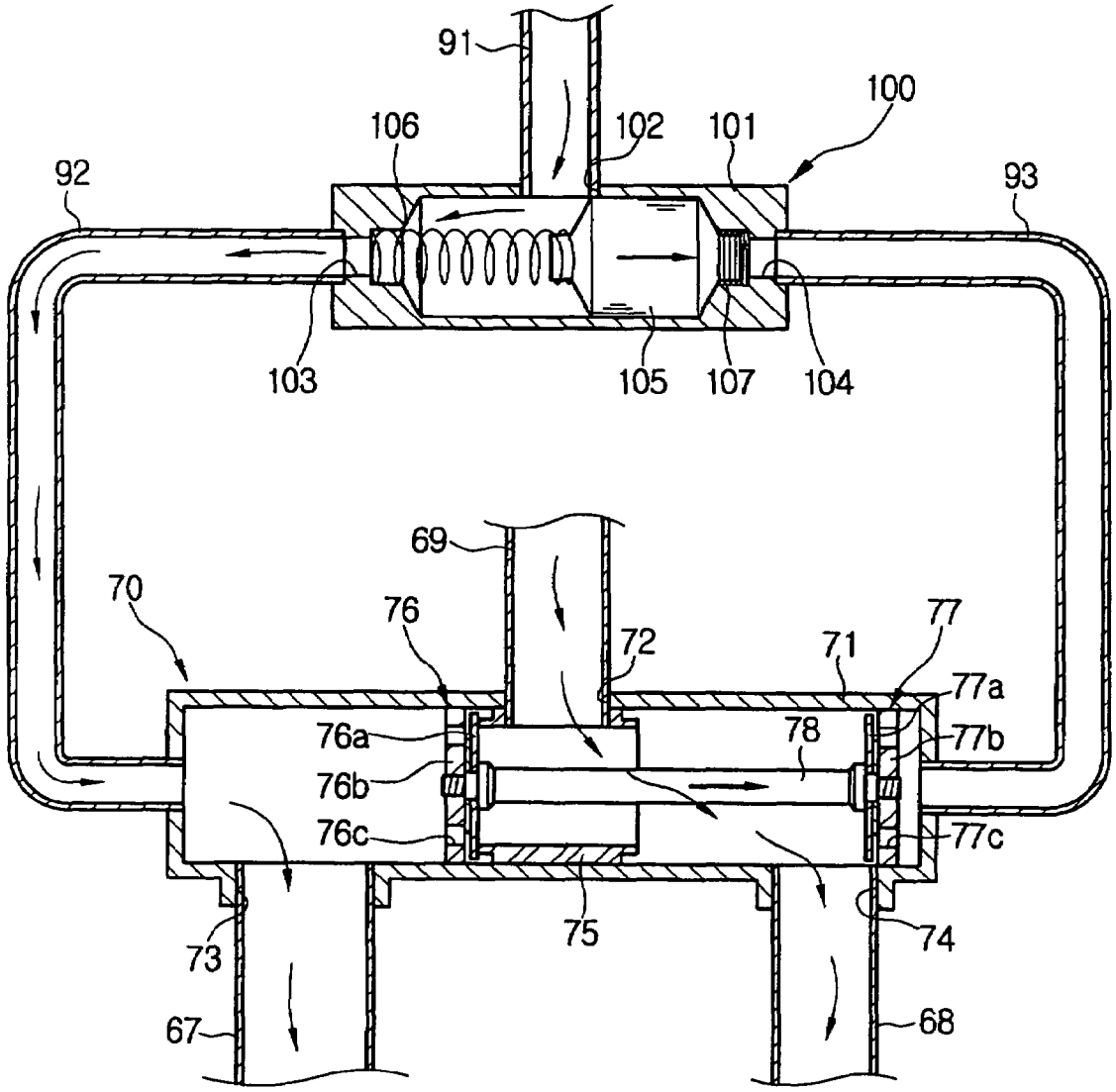
FIG. 8 is a sectional view to show the path controller and the pressure controller included in the variable capacity rotary compressor of FIG. 1, when the compression operation is executed in the second compression chamber.
Figure 9:
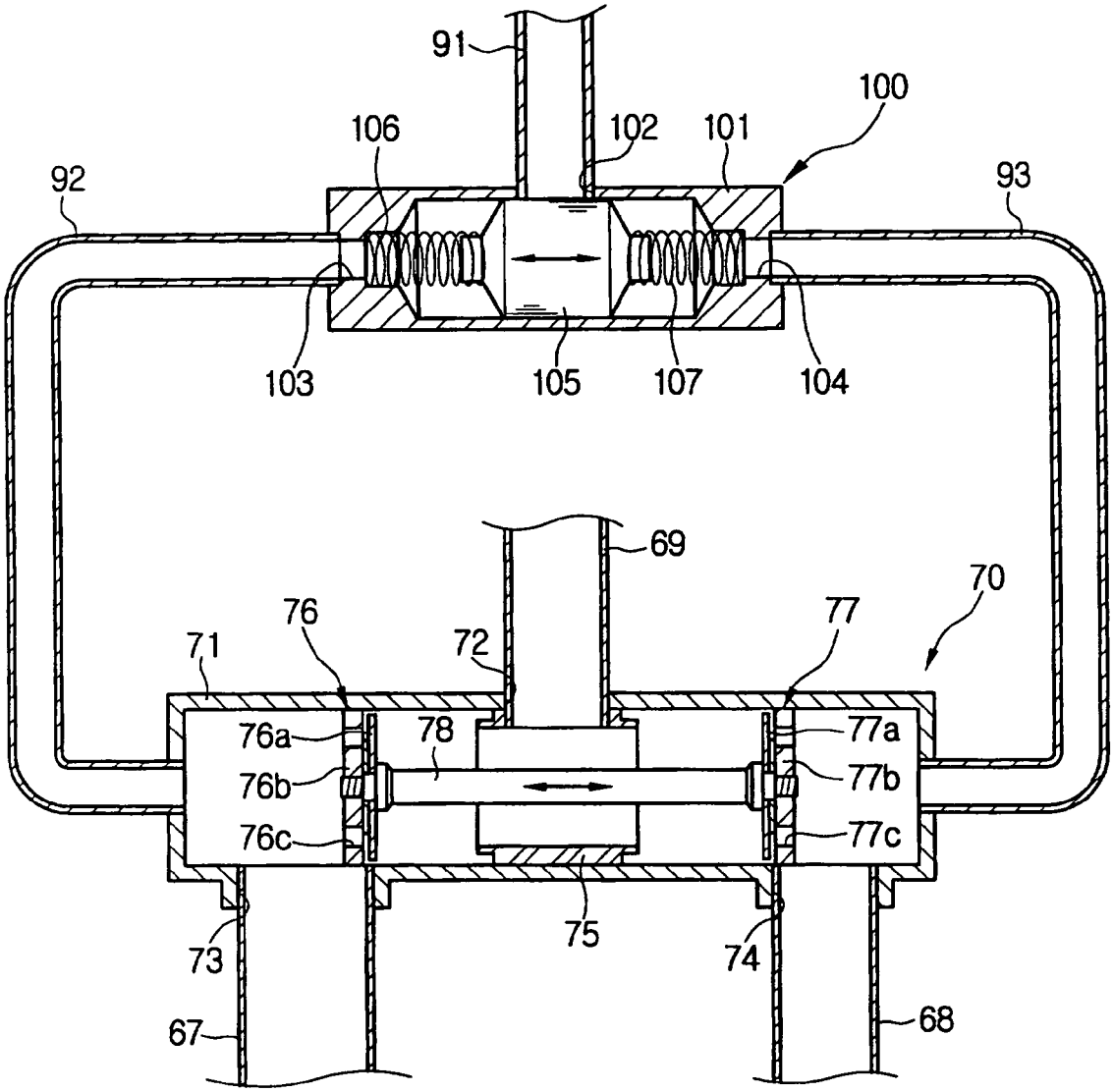
FIG. 9 is a sectional view to show the path controller and the pressure controller included in the variable capacity rotary compressor of FIG. 1, when the variable capacity rotary compressor is stopped.

As shown in FIGS. 7 to 9, the path controller 70 includes a hollow body 71. The body 71 has a cylindrical shape of a predetermined length, and is closed at both ends thereof. An inlet 72 is formed at a central portion of the body 71 to be connected to the refrigerant inlet pipe 69. First and second outlets 73 and 74 are formed on the body 71 at opposite sides of the inlet 72 to be spaced apart from each other. First and second pipes 67 and 68, which are connected to the inlet 63 of the first compression chamber 31 and the inlet 64 of the second compression chamber 32, respectively, are connected to the first and second outlets 73 and 74, respectively.

Further, the path controller 70 includes a valve seat 75, first and second valves 76 and 77, and a connecting member 78. The valve seat 75 has a cylindrical shape which is opened at both ends thereof, and is provided in the body 71 to form a step on an internal surface of the body 71. The first and second valves 76 and 77 are installed at both sides of the body 71, and axially reciprocate in the body 71 to open either end of the valve seat 75. The connecting member 78 connects the first and second valves 76 and 77 to each other so that the first and second valves 76 and 77 move together.

The valve seat 75 has an opening on a sidewall thereof to allow an interior space thereof to communicate with the inlet 72. In this case, the valve seat 75 is fitted into the body 71. The first and second valves 76 and 77 are mounted to both ends of the connecting member 78, respectively. The first valve 76 includes a thin valve plate 76*a* and a support member 76*b*, and the second valve 77 includes a thin valve plate 77*a* and a support member 77*b*. The valve plates 76*a* and 77*a* respectively come into contact with each end of the valve seat 75 to close a refrigerant path. The support members 76*b* and 77*b* are mounted to both ends of the connecting member 78 to movably support the valve plates 76*a* and 77*a* in the body 71, respectively. In this case, each of the support members 76*b* and 77*b* has an outer diameter corresponding to an inner diameter of the body 71 to smoothly reciprocate in the body 71. A plurality of holes 76*c* and 77*c* are formed on the support members 76*b* and 77*b*, respectively, to allow air ventilation.

As shown in FIG. 1, the variable capacity rotary compressor according to the present invention includes a pressure control unit. The pressure controller applies an outlet pressure of the rotary compressor to an inlet 63, 64 of a compression chamber 31, 32 where the idle operation is executed to allow the internal pressure of the compression chamber where the idle operation is executed, to be equal to the internal pressure of the hermetic casing 10. The pressure controller includes a connection pipe 91, first and second pressure control pipes 92 and 93, and a pressure control valve 100. The first and second pressure control pipes 92 and 93 branch from the connection pipe 91. The pressure control valve 100 is provided at a branching point of the first and second pressure control pipes 92 and 93.

An inlet of the connection pipe 91 is connected to an outlet pipe 94 of the rotary compressor, which is provided on an upper portion of the hermetic casing 10. The first and second pressure control pipes 92 and 93 branch from an outlet side of the connection pipe 91. Outlets of the first and second pressure control pipes 92 and 93 communicate with both sides of the body 71 of the path controller 70, respectively. In this case, the outlet of the first pressure control pipe 92 communicates with the first outlet 73 of the path controller 70 to define a first path to be connected to the inlet 63 of the first compression chamber 31. Further, the outlet of the second pressure control pipe 93 communicates with the second outlet 74 of the path controller 70 to define a second path to be connected to the inlet 64 of the second compression chamber 31.

As shown in FIGS. 7 to 9, the pressure control valve 100 is provided at a point where the first and second pressure control pipes 92 and 93 branch from the connection pipe 91. The pressure control valve 100 has, at a central portion thereof, an inlet 102 which is connected to the outlet of the connection pipe 91. Further, the pressure control valve 100 includes a valve body 101 and a valve member 105. The valve body 101 has first and second outlets 103 and 104 at opposite sides thereof, respectively. In this case, the first outlet 103 of the valve body 101 is connected to an inlet of the first pressure control pipe 92, while the second outlet 104 of the valve body 101 is connected to an inlet of the second pressure control pipe 93. The valve member 105 is set in the valve body 101 to axially reciprocate and to control a path in the valve body 101 to thereby control the path controller 70. The pressure control valve 100 also includes two elastic members (e.g. restoring springs) 106 and 107. The elastic members 106 and 107 are provided on both sides of the valve member 105 which is set in the valve body 101. Thus, when the rotary compressor is stopped, the valve member 105 is returned to a center of the valve body 101 by elasticity of the elastic members 106 and 107.

In the pressure control valve 100, the valve member 105 reciprocates in the valve body 101 due to a pressure difference between the first and second pressure control pipes 92 and 93 to control the path in the valve body 101 so that the connection pipe 91 communicates with either the first or second pressure control pipe 92 or 93.

The operation of the variable capacity rotary compressor will be described in the following.

Figure 4:
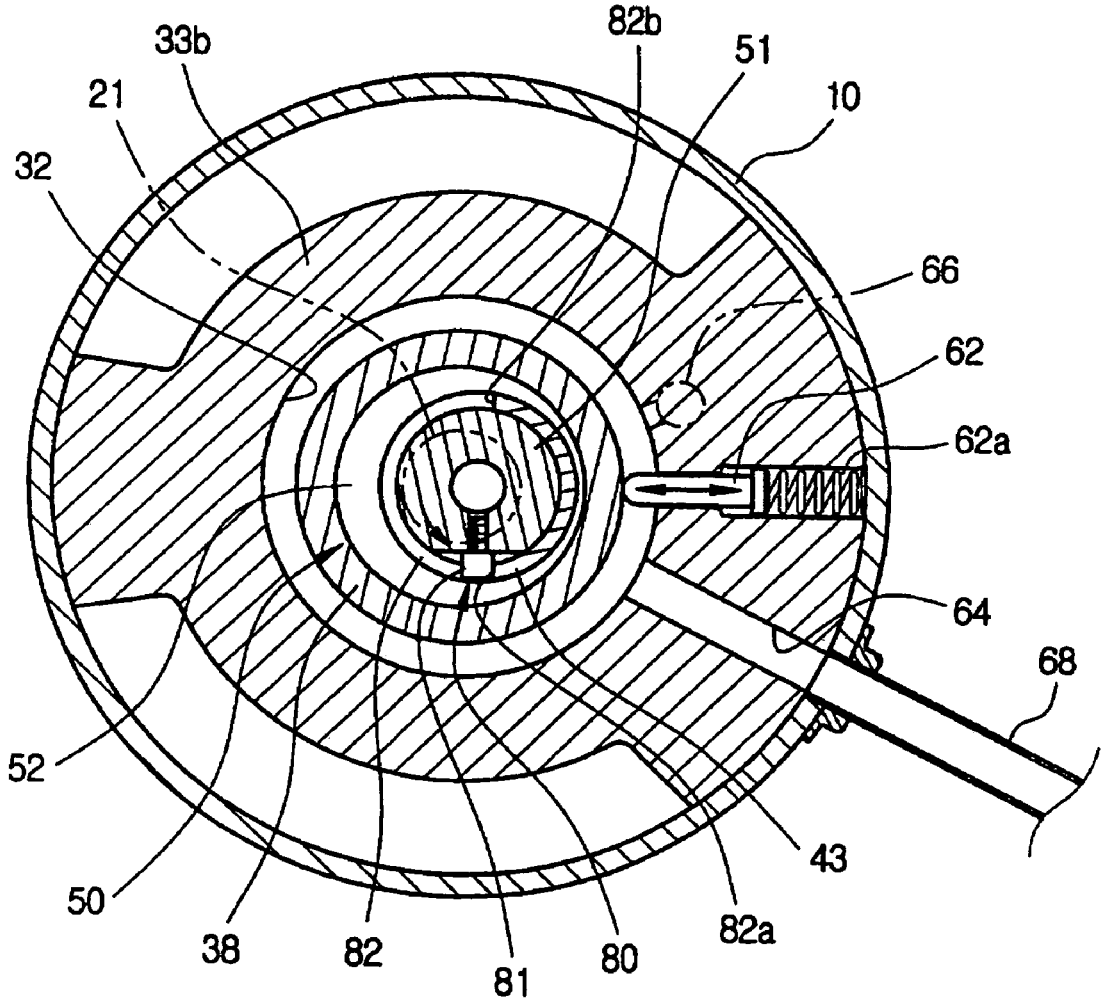
FIG. 4 is a sectional view to show an idle operation of a second compression chamber, when the rotating shaft of the variable capacity rotary compressor of FIG. 1 is rotated in the first direction.

As shown in FIG. 3, when the rotating shaft 21 is rotated in a first direction, an outer surface of the first eccentric bush 42 in the first compression chamber 31 is eccentric from the rotating shaft 21 and the locking pin 81 is locked by the first locking part 82*a* of the locking slot 82. Thus, the first roller 37 is rotated while contacting with an inner surface of the first compression chamber 31 to execute the compression operation in the first compression chamber 31. Meanwhile, in the second compression chamber 32 where the second eccentric bush 52 is placed, an outer surface of the second eccentric bush 52, which is eccentric in a direction opposite to the first eccentric bush 42, is concentric with the rotating shaft 21, and the second roller 38 is spaced apart from an inner surface of the second compression chamber 32, as shown in FIG. 4. Therefore, the idle operation is executed in the second compression chamber 32.

When the compression operation is executed in the first compression chamber 31, the refrigerant is delivered into the inlet 63 of the first compression chamber 31. The path controller 70 controls the path so that the refrigerant is delivered into only the first compression chamber 31. In this case, as shown in FIG. 7, the first and second valves 76 and 77 move in a direction toward the first outlet 73 due to a suction force applied to the first outlet 73 to form the refrigerant suction path so that the refrigerant is drawn into the first outlet 73. At this time, since the valve plate 77*a* of the second valve 77 closes the end of the valve seat 75 which communicates with the second outlet 74, a path where the refrigerant is drawn into the second outlet 74 is closed.

While the refrigerant suction path is controlled in this way, the pressure control valve 100 is operated as shown in FIG. 7. In this case, since the first pressure control pipe 92 communicates with the first outlet 73 of the path controller 70, the suction force acts on an interior of the first pressure control pipe 92. The valve member 105, provided in the valve body 101, moves toward the first pressure control pipe 92, so that the first outlet 103 adjacent to the first pressure control pipe 92 is closed and the second outlet 104 adjacent to the second pressure control pipe 93 is opened. At this time, the outlet pressure of the connection pipe 91 affects the second compression chamber 32 where the idle operation is executed, through the second pressure control pipe 93 and the second outlet 74 of the path controller 70. The interior of the second compression chamber 32, where the idle operation is executed, has a similar pressure as the interior of the hermetic casing 10 to prevent the second vane 62 from pressing the second roller 38 which executes the idle rotation, and to prevent oil from flowing into the second compression chamber 32. This allows the rotating shaft 21 to be smoothly rotated.

Figure 5:
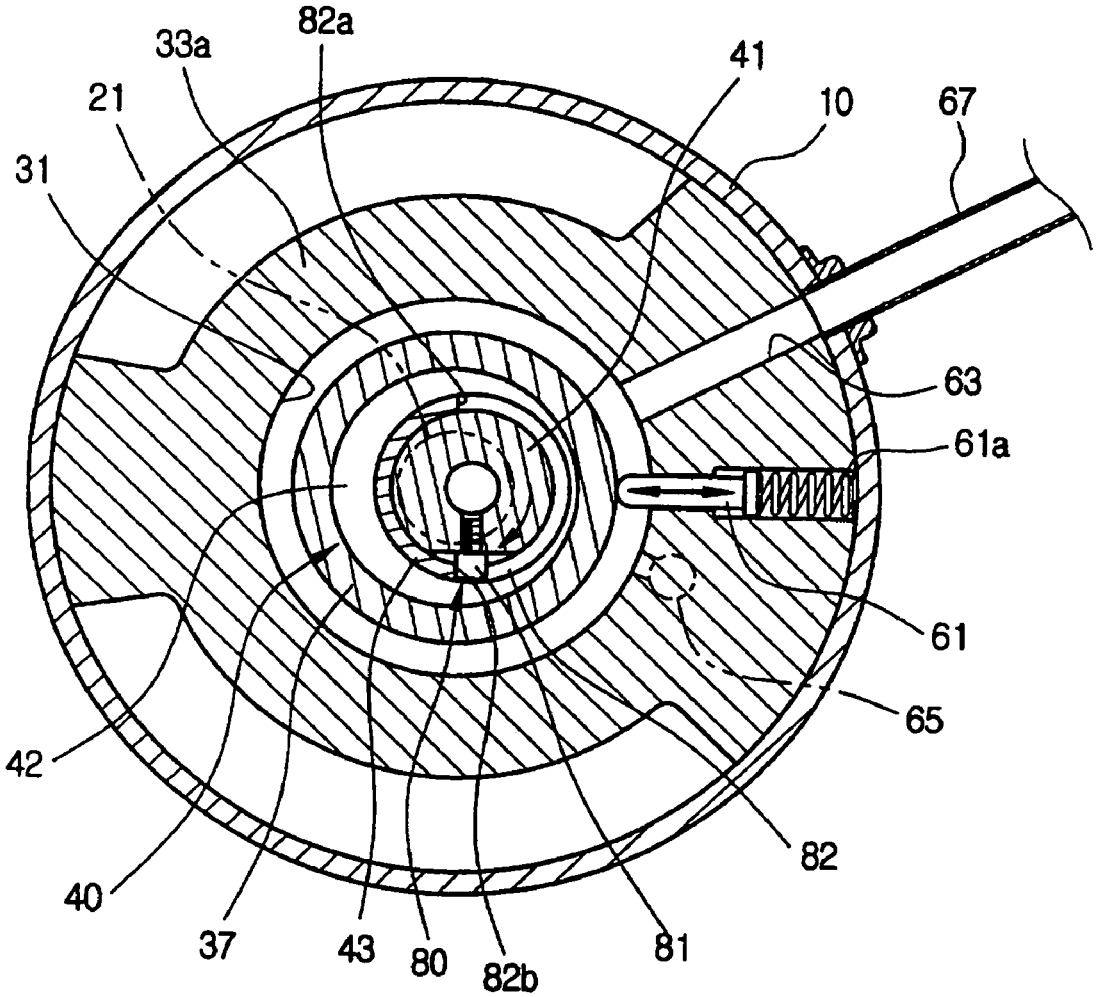
FIG. 5 is a sectional view to show an idle operation of the first compression chamber, when the rotating shaft of the variable capacity rotary compressor of FIG. 1 is rotated in a second direction.
Figure 6:
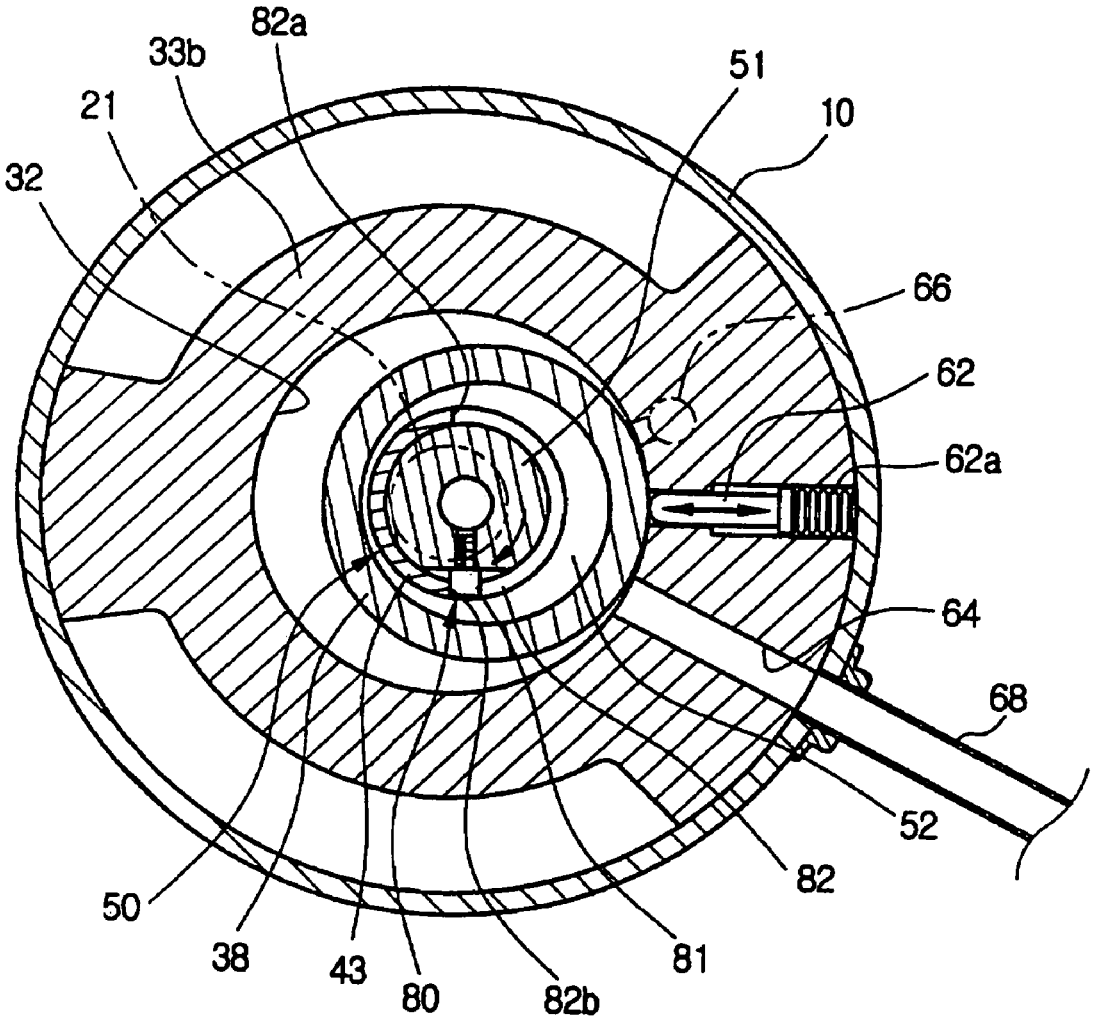
FIG. 6 is a sectional view to show a compression operation of the second compression chamber, when the rotating shaft of the variable capacity rotary compressor of FIG. 1 is rotated in the second direction.

Meanwhile, as shown in FIG. 5, when the rotating shaft 21 is rotated in a second direction, the outer surface of the first eccentric bush 42 in the first compression chamber 31 is released from the eccentricity from the rotating shaft 21 and the locking pin 81 is locked by the second locking part 82*b* of the locking slot 82. Thus, the first roller 37 is rotated while being spaced apart from the inner surface of the first compression chamber 31, so that the idle operation is executed in the first compression chamber 31. Meanwhile, in the second compression chamber 32 where the second eccentric bush 52 is placed, the outer surface of the second eccentric bush 52 is eccentric from the rotating shaft 21, and the second roller 38 is rotated while being in contact with the inner surface of the second compression chamber 32, as shown in FIG. 6. Therefore, the compression operation is executed in the second compression chamber 32.

When the compression operation is executed in the second compression chamber 32, the refrigerant is delivered into the inlet 64 of the second compression chamber 32. The path controller 70 controls the path so that the refrigerant is delivered into only the second compression chamber 32. In this case, as shown in FIG. 8, the first and second valves 76 and 77 move in a direction toward the second outlet 74 due to suction force applied to the second outlet 74 to form the refrigerant suction path so that the refrigerant is drawn into the second outlet 74. At this time, since the valve plate 76*a* of the first valve 76 closes the end of the valve seat 75 which communicates with the first outlet 73, a path where the refrigerant is drawn into the first outlet 73 is closed.

While the refrigerant suction path is controlled in this way, the pressure control valve 100 is operated as shown in FIG. 8. In this case, since the second pressure control pipe 93 communicates with the second outlet 74 of the path controller 70, the suction force acts on an interior of the second pressure control pipe 93. The valve member 105, provided in the valve body 101, moves toward the second pressure control pipe 93, so that the second outlet 104 adjacent to the second pressure control pipe 93 is closed and the first outlet 103 adjacent to the first pressure control pipe 92 is opened. At this time, the outlet pressure of the connection pipe 91 affects the first compression chamber 31 where the idle operation is executed, through the first pressure control pipe 92 and the first outlet 73 of the path controller 70. The interior of the first compression chamber 31, where the idle operation is executed has the same pressure as the interior of the hermetic casing 10 to prevent the first vane 61 from pressing the first roller 37 which executes the idle rotation, and to prevent oil from flowing into the first compression chamber 31. This allow the rotating shaft 21 to be smoothly rotated.

When the rotary compressor stops operating, the pressure control valve 100 is operated as shown in FIG. 9. Since the suction force does not act on both the first and second pressure control pipes 92 and 93, the valve member 105 is returned to the center of the valve body 101 by the elasticity of the elastic members 106 and 107 which are provided on the both sides of the valve member 105. In this case, the valve member 105 closes the outlet of the connection pipe 91. Such a state allows the pressure control valve 100 to be smoothly operated when the rotary compressor is re-started to allow the refrigerant suction path to be easily varied.

As is apparent from the above description, the present invention provides a variable capacity rotary compressor, which is designed such that a compression operation is selectively performed in one of two compression chambers having different capacities, according to a rotating direction of a rotating shaft, thus precisely varying a compression capacity to obtain a desired exhaust pressure, and easily controlling the compression capacity of the rotary compressor.

Further, the present invention provides a variable capacity rotary compressor having a pressure controller which is operated to apply an internal pressure of a hermetic casing to a compression chamber where an idle operation is executed, so that there is no pressure difference between the interior of the compression chamber where the idle operation is executed and the interior of the hermetic casing, to prevent a vane installed in the compression chamber where the idle operation is executed from pressing a roller and to prevent a rotating resistance from occurring, therefore increasing operational efficiency of the rotary compressor.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, including a hermetic casing, a housing installed in the hermetic casing to define therein first and second compression chambers having different capacities, and a compressing unit placed in the first and second compression chambers to execute a compression operation in one of the first and second compression chambers according to a rotating direction of a rotating shaft which drives the compressing unit, the variable capacity rotary compressor comprising:

a first path to connect an outlet side of the rotary compressor to an inlet of the first compression chamber;

a second path to connect the outlet side of the rotary compressor to an inlet of the second compression chamber; and a pressure controller to open one of the first and second paths, so that a pressure of the outlet side of the rotary compressor acts on the inlet of the first or second compression chamber where an idle operation is executed.

2. The variable capacity rotary compressor according to claim 1, wherein the pressure controller comprises:

a connection pipe to communicate with an interior of the hermetic casing;

a first pressure control pipe branching from the connection pipe, having an outlet to communicate with the inlet of the first compression chamber, to define the first path;

a second pressure control pipe branching from the connection pipe, having an outlet to communicate with the inlet of the second compression chamber, to define the second path; and a pressure control valve at a branching point of the first and second pressure control pipes, to operate as a result of a pressure difference between the first and second pressure control pipes to open one of the first and second paths.

3. The variable capacity rotary compressor according to claim 2, wherein the pressure control valve includes a valve body, the valve body comprising:

an inlet at a central portion of the valve body to connect to an outlet of the connection pipe;

a first outlet at a first side of the valve body to connect to an inlet of the first pressure control pipe; and a second outlet at a second side of the valve body opposite to the first outlet to connect to an inlet of the second pressure control pipe; and a valve member in the valve body to reciprocate and to open one of the first and second paths.

4. The variable capacity rotary compressor according to claim 3, wherein the pressure control valve further comprises a restoring elastic member at each of opposite sides of the valve member to cause the valve member to return to a center of the valve body when the rotary compressor is stopped.

5. A variable capacity rotary compressor, including a hermetic casing, a housing installed in the hermetic casing to define therein first and second compression chambers having different capacities, and a compressing unit placed in the first and second compression chambers to execute a compression operation in one of the first and second compression chambers according to a rotating direction of a rotating shaft which drives the compressing unit, the variable capacity rotary compressor further comprising:

a path controller to control a refrigerant suction path to feed refrigerant to an inlet of one of the first and second compression chambers where the compression operation is executed;

a first path to connect an outlet side of the compressor to a first outlet of the path controller so that the outlet side of the rotary compressor communicates with the first outlet of the path controller;

a second path to connect the outlet side of the rotary compressor to a second outlet of the path controller so that the outlet side of the rotary compressor communicates with the second outlet of the path controller; and a pressure controller to open one of the first and second paths, so that a pressure of the outlet side of the rotary compressor acts on the inlet of one of the first and second compression chambers where an idle operation is executed.

6. The variable capacity rotary compressor according to claim 5, wherein the path controller comprises:

a hollow body, comprising:

an inlet, at a central portion of the hollow body, coupled to a refrigerant inlet pipe;

first and second outlets on the hollow body at opposite sides of the inlet of the hollow body to be coupled to the inlets of the first and second compression chambers, respectively;

a valve seat in the hollow body to allow an interior of the valve seat to communicate with the inlet of the hollow body and to allow both ends of the vale seat to communicate with the first and second outlets of the hollow body, respectively; and first and second valves at each of both ends of the valve seat, respectively, and axially reciprocating in the hollow body to open either of the both ends of the valve seat, the first and second valves being coupled to each other by a connecting member.

7. The variable capacity rotary compressor according to claim 6, wherein the pressure controller comprises:

a connection pipe to communicate with an outlet side of the rotary compressor;

first and second pressure control pipes branching from the connection pipe, with outlets of the first and second pressure control pipes respectively communicating with opposite sides of the hollow body of the path controller, to define the first and second paths, respectively; and a pressure control valve, at a branching point of the first and second pressure control pipes, to operate due to a pressure difference between the first and second pressure control pipes to open one of the first and second paths.

8. The variable capacity rotary compressor according to claim 7, wherein the pressure control valve includes a valve body, comprising:

an inlet at a central portion of the valve body to connect to an outlet of the connection pipe;

a first outlet at a first side of the valve body to connect to an inlet of the first pressure control pipe; and a second outlet at a second side of the valve body opposite to the first outlet to connect to an inlet of the second pressure control pipe; and a valve member in the valve body to reciprocate and to open one of the first and second paths.

9. The variable capacity rotary compressor according to claim 8, wherein the pressure control valve further comprises a restoring elastic member at each of opposite sides of the valve member to cause the valve member to return to a center of the valve body when the rotary compressor is stopped.

10. The variable capacity rotary compressor according to claim 6, wherein each of the first and second valves comprises:

a thin valve plate able to come into contact with the valve seat; and a support member to support the valve plate in the hollow body.

11. The variable capacity rotary compressor according to claim 10, further comprising a plurality of holes provided on the support member.

12. A rotary compressor, including first and second compression chambers to execute compression and idle operations, in which when one of the compression chambers executes the compression operation the other executes the idle operation and vice versa, the rotary compressor comprising:

a first path to connect an outlet of the rotary compressor to an inlet of the first compression chamber;

a second path to connect the outlet of the rotary compressor to an inlet of the second compression chamber; and a pressure controller to open one of the first and second paths, so that a pressure of the outlet side of the rotary compressor acts on the one inlet of the first and second compression chambers in which an idle operation is executed.

13. The rotary compressor according to claim 12, further comprising a hermetic casing, wherein the pressure controller comprises a connection pipe to communicate with an interior of the hermetic casing.

14. The rotary compressor according to claim 13, wherein the pressure controller further comprises a first pressure control pipe, branching from the connection pipe, and having an outlet to communicate with the inlet of the first compression chamber to define the first path.

15. The rotary compressor according to claim 14, wherein the pressure controller further comprises a second pressure control pipe, branching from the connection pipe, and having an outlet to communicate with the inlet of the second compression chamber.

16. The rotary compressor according to claim 15, wherein the pressure controller further comprises a pressure control valve at a branching point of the first and second pressure control pipes, to operate as a result of a pressure difference between the first and second pressure control pipes to open one of the first and second paths.

17. A path controller to control a refrigerant suction path to feed refrigerant to an inlet of one of first and second compression chambers of a rotary compressor, in which a compression operation is executed, comprising:

a first path to connect an outlet side of the rotary compressor to a first outlet of the path controller;

a second path to connect the outlet side of the rotary compressor to a second outlet of the path controller; and a pressure controller to open one of the first and second paths, so that a pressure of the outlet side of the rotary compressor acts on the inlet of one of the first and second compression chambers where an idle operation is executed.

18. The path controller according to claim 17, wherein the path controller comprises a hollow body in which a direction of a refrigerant path is regulated.

19. The path controller according to claim 18, wherein the hollow body further comprises:

an inlet in the hollow body through which refrigerant is delivered; and first and second outlets, at opposite sides of the inlet, coupled to the inlets of the first and second compression chambers, respectively.

20. The path controller according to claim 19, wherein the hollow body further comprises:

a valve seat having an interior communicating with the inlet of the hollow body and ends communicating with the first and second outlets, respectively; and first and second valves at each the ends of the valve seat, respectively, to axially reciprocate in the hollow body to open one of the ends of the valve seat.

21. The path controller according to claim 20, wherein a connecting member connects the first and second valves to one another.

22. The path controller according to claim 20, wherein the pressure controller comprises:

a connection pipe to communicate with an outlet side of the rotary compressor;

first and second pressure control pipes branching from the connection pipe, having outlets respectively communicating with opposite sides of the hollow body of the path controller to define the first and second paths, respectively; and a pressure control valve, at a branching point of the first and second pressure control pipes, to operate due to a pressure difference between the first and second pressure control pipes to open one of the first and second paths.

23. The path controller according to claim 22, wherein the pressure control valve includes a valve body, the valve body comprising:

an inlet at a central portion of the valve body to connect to an outlet of the connection pipe;

a first outlet at a first side of the valve body to connect to an inlet of the first pressure control pipe; and a second outlet at a second side of the valve body opposite to the first outlet to connect to an inlet of the second pressure control pipe; and a valve member in the valve body to open one of the first and second paths.

24. A rotary compressor, including first and second compression chambers to execute compression and idle operations, in which when one of the compression chambers executes the compression operation the other executes the idle operation and vice versa, the rotary compressor comprising:

a first path to connect an outlet of the rotary compressor to an inlet of the first compression chamber;

a second path to connect the outlet of the rotary compressor to an inlet of the second compression chamber; and a pressure controller to apply an internal pressure of the rotary compressor to an interior of the one compression chamber which executes the idle operation, wherein a pressure differential between the internal pressure of the rotary compressor and the interior of the compression chamber which executes the idle operation is minimized.

* * * * *